US005078055A

United States Patent [19]

Bellini et al.

[11] Patent Number: 5,078,055

[45] Date of Patent: Jan. 7, 1992

[54] WORKING TABLE

[75] Inventors: Mario Bellini, Milan, Italy; Dieter Thiel, Basel, Switzerland

[73] Assignee: Protoned B. V., Amsterdam, Netherlands

[21] Appl. No.: 422,416

[22] Filed: Oct. 17, 1989

[30] Foreign Application Priority Data

Oct. 17, 1988 [CH] Switzerland ..... 3863/88

[51] Int. Cl.[5] ..... A47B 57/00

[52] U.S. Cl. ..... 108/64; 108/153

[58] Field of Search ..... 108/64, 69, 65, 5, 9, 108/1, 50, 143, 159, 97, 114, 153

[56] References Cited

U.S. PATENT DOCUMENTS

| | | | |
|---|---|---|---|
| 2,522,296 | 9/1950 | Overstedt | 108/9 |
| 3,745,935 | 7/1973 | Douglas | 108/5 X |
| 4,223,613 | 9/1980 | Yoshizawa | 108/102 X |
| 4,441,432 | 4/1984 | Carlton | 100/5 |
| 4,615,279 | 10/1986 | De La Hayes | 108/65 X |
| 4,630,550 | 12/1986 | Weitzman | 100/153 X |
| 4,637,666 | 1/1987 | Warrell et al. | 108/143 X |
| 4,639,049 | 1/1987 | Frascaroli et al. | 108/64 X |
| 4,645,878 | 2/1987 | Hilge et al. | 108/64 X |
| 4,659,048 | 8/1987 | Fahrion | 108/102 X |
| 4,840,441 | 6/1989 | Tsay | 108/64 X |

*Primary Examiner*—José V. Chen

*Attorney, Agent, or Firm*—Ralph W. Selitto, Jr.

[57] ABSTRACT

The work table with a carrying structure held above the floor by supporting elements (4, 5) and devices for holding table surfaces and/or add-ons in the form of fixedly or moveably arranged resting surfaces includes a base frame (1) of a pair of longitudinal bearers (2) and a pair of transverse bearers (3), which is designed as a structural unit. The supporting elements are fastened to this structural unit as individual table legs (4) or box member in the form of drawer units (5), attached detachably on the underside of the base frame (1). Some of the ends of the longitudinal and/or transverse bearers of the base frame (1) are designed as coupling or resting regions for attachments or add-ons of the work table.

Due to the interchangeability of leaf frames (7, 7'') which can be coupled to the base frame (1) and bracket elements, the components of the work table can be used on the modular principle.

14 Claims, 5 Drawing Sheets

WORKING TABLE

FIELD OF THE INVENTION

The invention relates to a work table and in particular to a work table designed on the modular principle.

Work tables of this type are suitable due to their adaptability to very different operating requirements both as office furniture with a working surface or layout surface and attachments and add-ons for shelves or equipment resting surfaces, and for laboratory workplaces, in which both writing surfaces and depositing surfaces are required for different working and examining operations.

SUMMARY OF THE INVENTION

The object of the present invention is to provide a work table in which, starting from a base frame with foot elements and bracket elements, there are (sic) for receiving a table top, and a number of leaf frames which can be optionally connected on the base frame and/or to a side thereof, having their own foot elements and depositing surfaces which can be added on to the leaf frame itself and are connected solidly or jointedly thereto. In this case, the base frame is to be designed as a unit with receptacles for the attaching of line elements and terminal elements, for example for electric current, telephone, etc.

The advantage of the work table according to the invention is to be seen in the extensive adaptability to the individual requirements and to different workplaces. Due to the interchangeability of leaf frames which can be coupled in a swinging manner and various bracket elements on the base frame, the components of the work table can also be used on the modular principle. Consequently, a work table designed according to the invention can be adapted easily to different requirements.

BRIEF DESCRIPTION OF THE DRAWINGS

Details of the preferred alternate embodiments and the subject of the invention emerge from the following description of to the drawing, in which.

DETAILED DESCRIPTION OF THE DRAWINGS

Figure 1:
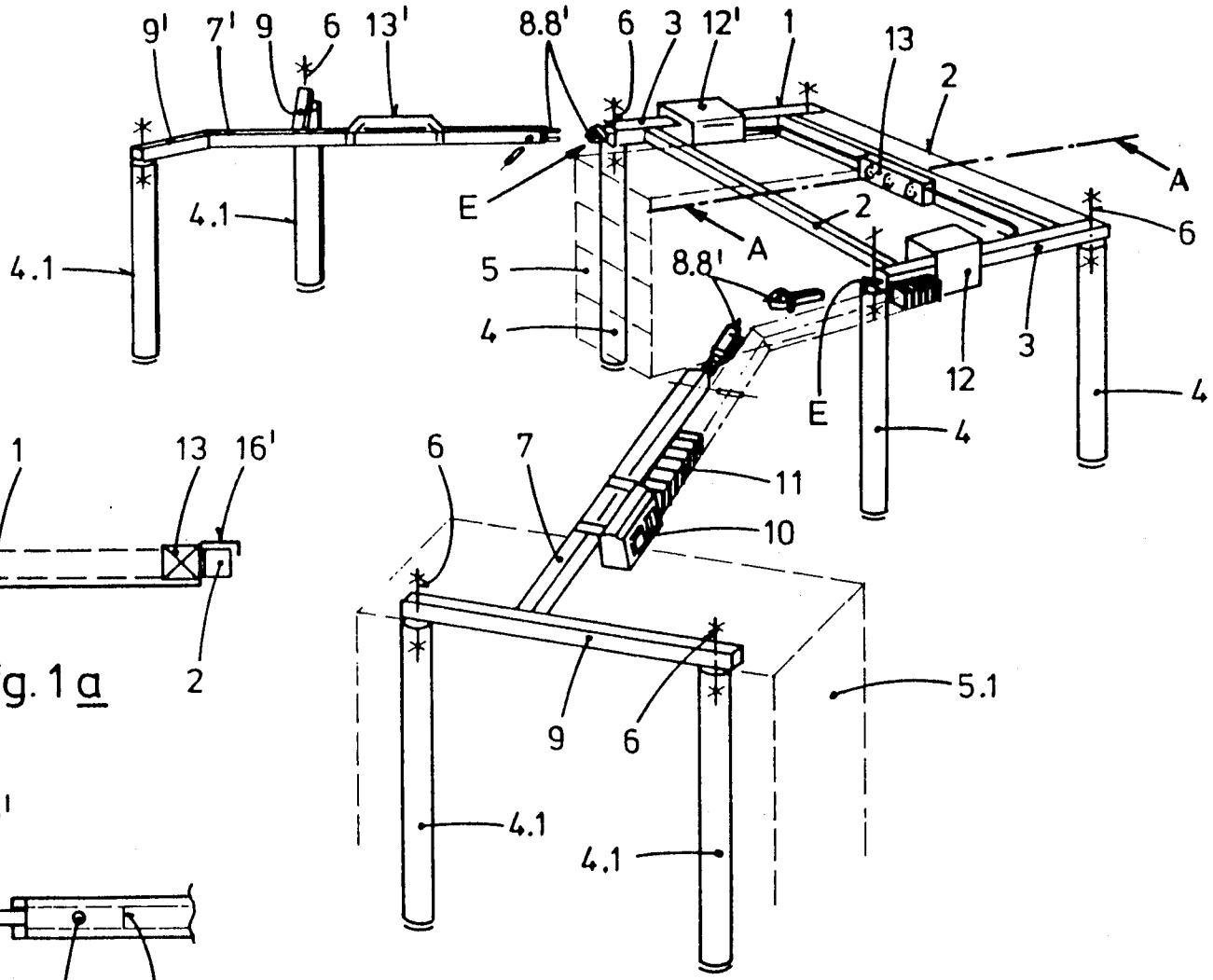
FIG. 1 diagrammatically shows a base frame in perspective representation with leaf frames which can be connected to a side thereof.

In FIG. 1, reference numeral 1 generally denotes a base frame of the work table according to the invention, which frame consists of a front and a rear longitudinal bearer 2 and a left and a right transverse bearer 3. These bearers 2, 3 are preferably made from hollow sectional bars and are expediently interconnected, abutting one against the other, by welding. The hollow sectional bars 2, 3 may be arranged lying in the same plane or interconnected with the ends lying one on top of the other.

The base frame 1 rests on supporting elements in the form of table legs 4 or one or two box members in the form of drawer units 5 (shown in broken line), which are detachably connected to the base frame 1 by means of screw connections 6.

In continuation of the transverse bearer 3, leaf frames 7, 7', which can swing in relation to the latter, can be jointedly coupled to the base frame 1. The coupling is performed by means of joint connection elements 8, which can be fitted into the ends of the hollow sectional bars and are explained in more detail with reference to FIG. 2. The leaf frames 7,7', expediently coupled in a cantilevered manner at corner points E of the base frame 1, are likewise designed as hollow sectional bars and are provided at their outer ends with carrying elements 9, 9', which for their part rest on supporting elements, for example, in the form of table legs 4.1 or box members 5.1. The table legs 4.1 or other supporting elements to be used in their place are expediently the same design as the supporting elements 4, 5 of the base frame 1, and like the latter are connected to the carrying elements 9 by detachable screw connections 6.

In order to equip the work table with all the supply lines usually necessary on the latter for electric current, telephone, compressed air, gas, etc., the table may be provided with corresponding terminal elements. FIG. 1 shows in this respect terminal fittings for electric current with a fuse and control box 10; a flexible cable duct 11, bypassing the joint connection elements 8, a first distribution box 12 and a plug connector 13. All of the electrical equipment to be arranged in the region of the base frame can be connected to the latter. Corresponding terminal fittings for electrical equipment to be arranged in the region of the left-hand leaf frame 7' may comprise a second distribution box 12' and a second plug connector 13'.

Figure 1A:
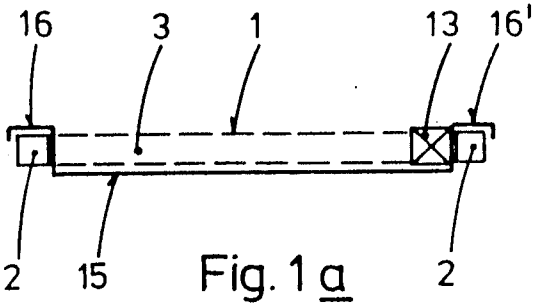
FIG. 1*a* shows a section along the line A—A in FIG. 1 for the representation of a built-in tray in the base frame, for example for the accommodation of incidentals and tools.

Shown diagrammatically in FIG. 1*a* is a tray 15, recognizable from the section A—A of FIG. 1, which is fitted in the clearance in the base frame bounded by the longitudinal and transverse bearers 2, 3 and is for receiving operating materials such as cables, tools, etc. This tray is expediently shaped out of sheet steel and can be designed with edge zones 16, 16', which cover the relevant sections of the longitudinal and/or transverse bearers 2, 3. The plug connector 13 is in this case expediently arranged inside the tray.

Figure 2:
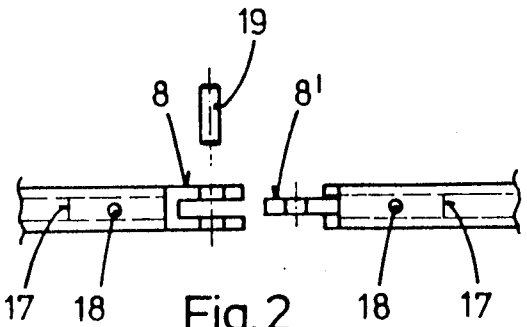
FIG. 2 diagrammatically shows the connection parts of a leaf frame to the base frame.

FIG. 2 diagrammatically shows an embodiment of the joint connection elements 8, 8' for the swinging connection of a leaf frame 7, 7' to the base frame 1 in a pulled-apart state. The connection elements 8, 8' shown as hinge elements are provided with connection pins 17, fitted into the opening of the frame hollow sections, and are secured therein by means of clamping elements 18.

After pushing together of the complementary hinge elements, they are locked with respect to each other by a (self-locking) insert pin 19.

The base frame 1 and the leaf frames 7, 7' serve primarily for receiving depositing surfaces or their carrying elements. The principle of the coupling of a table top 21 to the base frame 1 can be seen from FIGS. 3*a* and 3*b*. The base frame bears, on its side 1.1 facing the user, a perforated strip 22 with a number (five in FIG. 3*a*) of holes 23, which are arranged one above the other perpendicularly to the frame plane and are oriented parallel to the frame plane. On the underside of the table top 21 and opposite the perforated strip 22 there is an angled-off swivel lever 24 mounted in counter-clockwise direction on a pin 25. The downwardly directed arm 26 of the swivel lever 24 contains next to its lower end a bore for receiving an extractable insert pin (not shown). The latter is marked in the drawing as a black circle. A housing 27, containing the swivel lever 24, is supported on a rest 28. This arrangement, of course, exists mirror-symmetrically on both sides of the table top 21 or on the base frame.

On the side 1.2 of the base frame 1 away from the user, there is a bearing element 29 mounted on either side of the said frame, with a longitudinal slot guide 30, which has an upwardly open access opening 31 at its front end. These two bearing elements 29 may be interconnected by a traverse element 32, extending over the width of the base frame 1. On the underside of the table top 21 there are fastened L-shaped latching plates 33, which correspond to the bearing elements 29 and contain on their downwardly directed leg 34 a number of holes 35 for receiving an insert pin (not shown). This insert pin is intended to engage in the longitudinal slot guide 30, as FIG. 3*a* shows by the marking with a black circle.

Figure 3A:
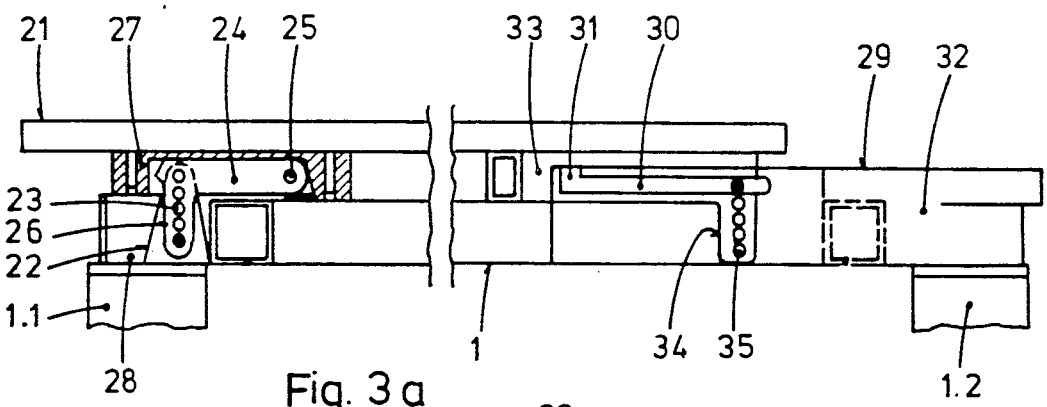
FIG. 3*a* shows details for the assembly of the table top on the base frame.

In FIG. 3*a*, the position of the swivel lever 24 and of the latching plate 33 with horizontal table top 21 and lowermost position of the same, in each case with respect to the base frame 1, is shown. For the case where a higher position of the table top is desired, the insert pin (black circle) on the swivel lever 24 would have to be inserted in a higher-placed hole 23 of the perforated strip 22 and the table top 21 thereby raised to the desired height. At the same time, on the latching plate 33, the insert pin marked there by a black circle would have to be inserted in a correspondingly lower hole 35 in the leg 34. The level of the holes 23 and 35 is matched in such a way that the table top 21 can always be brought into a horizontal position.

Figure 3B:
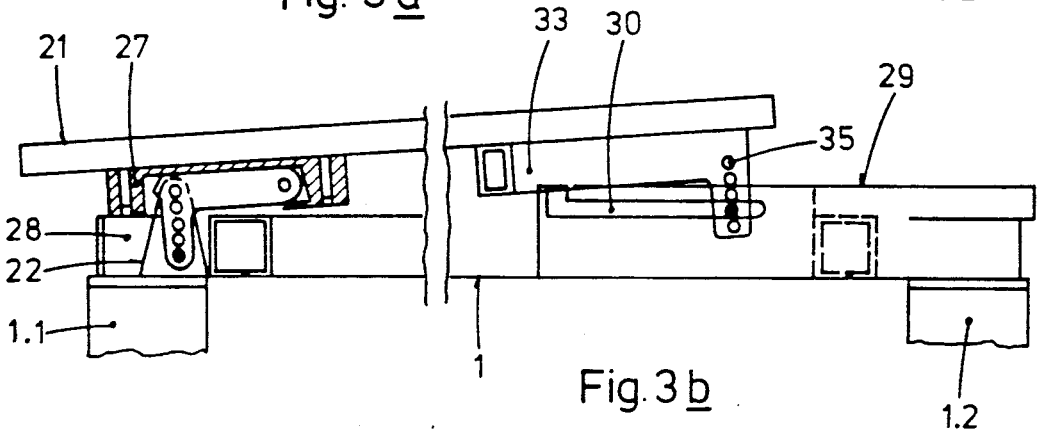
FIG. 3*b* shows the possibility of inclining the table top in relation to the base frame.

FIG. 3*b* shows the table top 21 in a position inclined toward the user. The position of the insert pin marked black in the perforated strip 22 and in the swivel lever 24 is the same as in FIG. 3*a* and, like there, the swivel lever housing 27 is supported on the rest 28. What is different, on the other hand, is that the insert pin marked black is inserted in a lower hole of the holes 35 in the latching plate 33 on the table side 1.2 away from the user. The pin engagement in the longitudinal slot guide 30 has the effect of raising the table top 21 there.

Figure 3C:
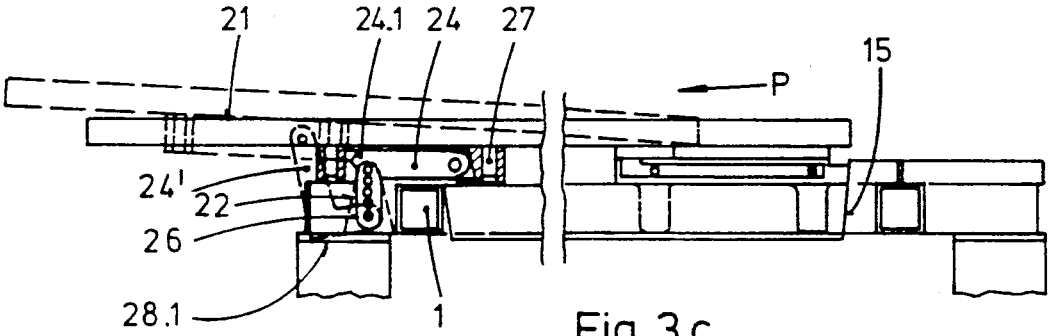
FIGS. 3*c*, 3*d* show representations to explain the handling of the table top on the base frame.
Figure 3D:
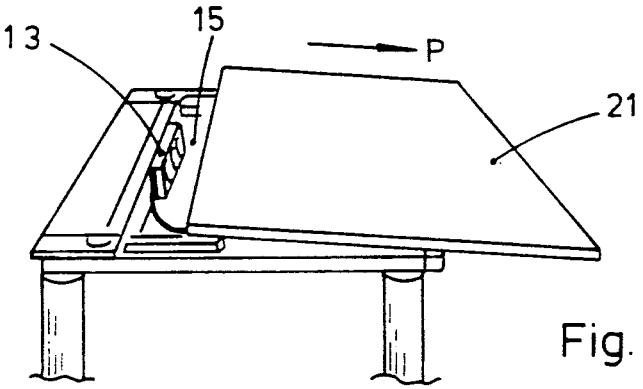

In order on the one hand to make possible the relocating of the insert pins of the rear bearing arrangement 29/33 and on the other hand to make the tray 15 and the plug connector 13 accessible, the table top 21 according to FIGS. 3*c* and 3*d* can be drawn out from the two positions of FIGS. 3*a* and 3*b* toward the user without becoming detached from the base frame 1. Responsible for this is the swivel lever 24, which swivels in a counterclockwise direction in arrow direction P about its bearing points in the swivel lever housing 27 and on the perforated strip 22 when the table top 21 is drawn out, until its knee 24.1 comes up against the rest 28.1.

Figure 4:
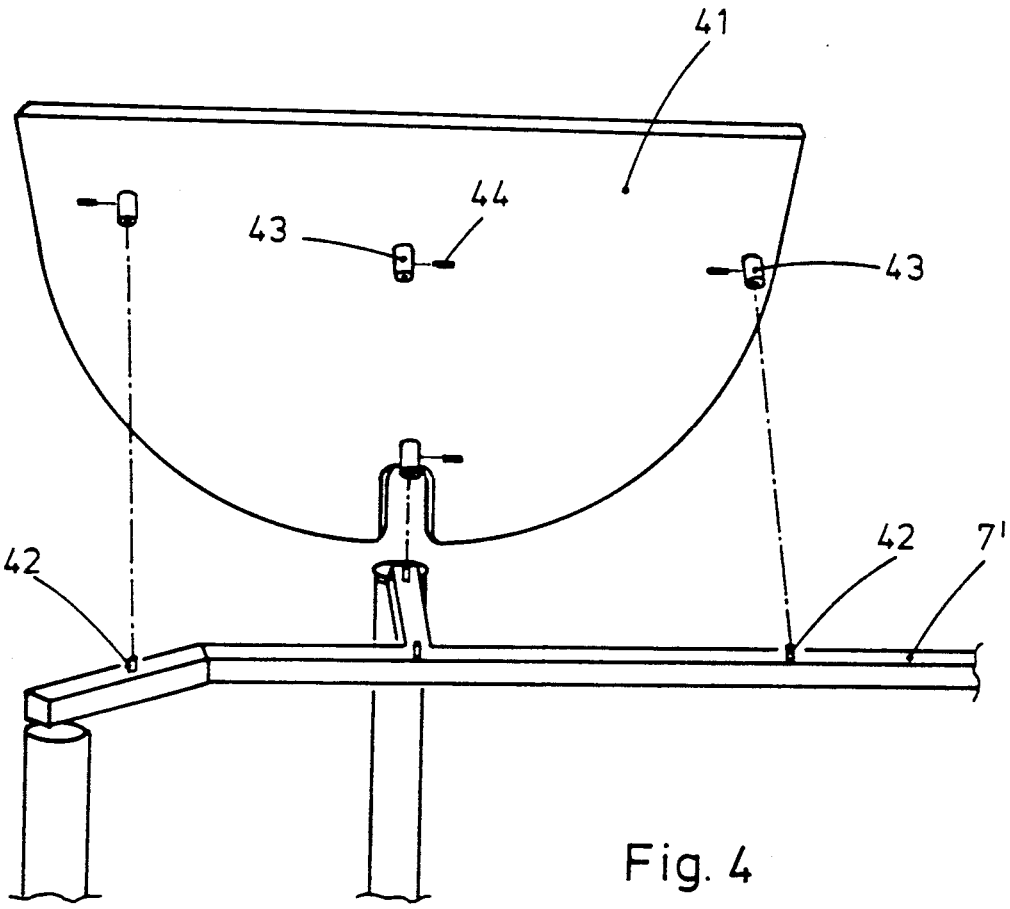
FIG. 4 shows the arrangement of a resting surface on a leaf frame, with swung-up resting surface.

FIG. 4 shows the arrangement of a resting surface or a table top 41 on a leaf frame 7'. The latter contains at predetermined points a number of insert pins 42, the position of which coincides with the arrangement of fitting bushes 43 on the underside of the resting surface or table top 41. The fitting bushes 43 are provided with clamping screws 44, which can be screwed in laterally and by means of which the resting surface or table top 41 is fixed on the leaf frame 7' after fitting of the fitting bushes 43 on the insert pins 42.

Figure 5:
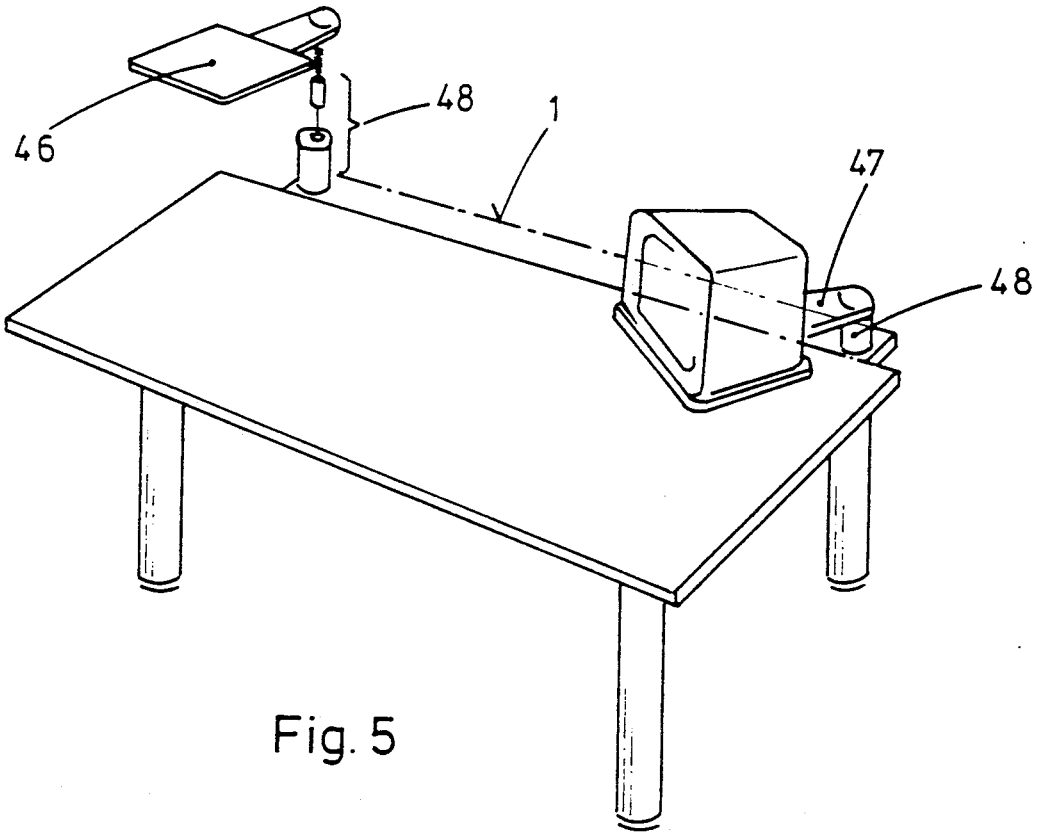
FIG. 5 diagrammatically shows a swivel arm arrangement for telephone or monitor shelves.
Figure 6:
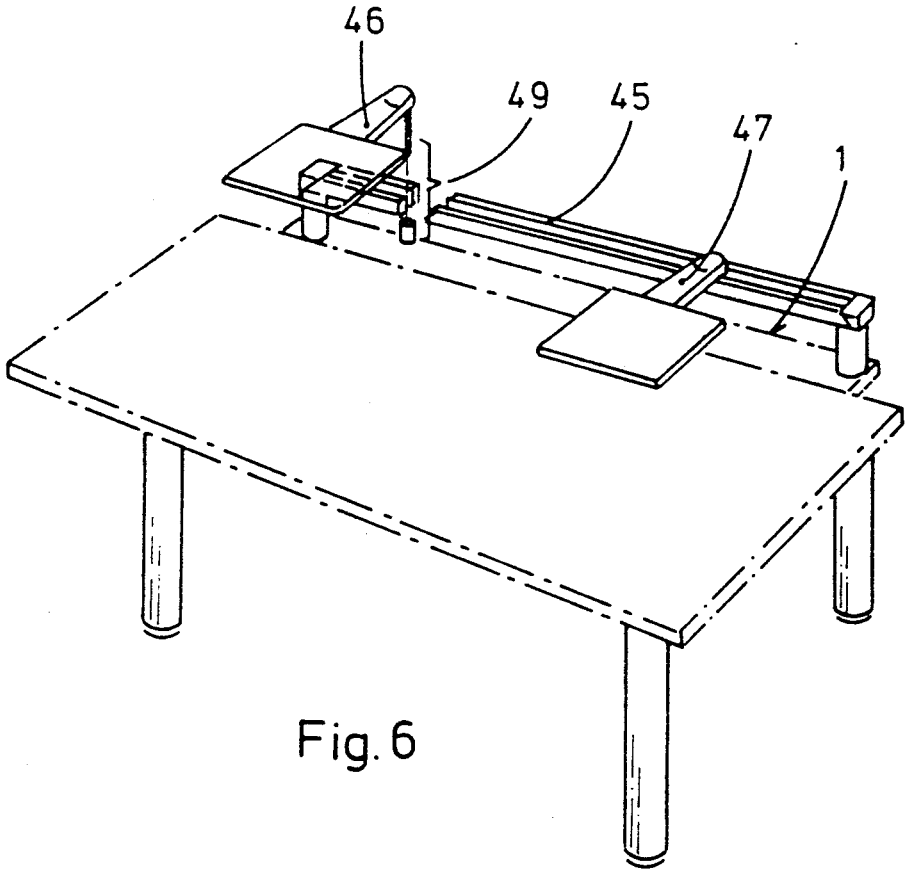
FIG. 6 shows the arrangement of a shelf longitudinal bearer on the base frame.

Arrangements of table add-ons are shown in FIGS. 5 and 6, as assembled on the base frame 1 directly (FIG. 5), or via a mounting rail 45 (FIG. 6). In both FIGS. 5 and 6, the same swing-type resting tables 46 and 47 are shown, which are fastened in each case on the corresponding assembly areas, in each case by adapted additional elements 48, 49.

Figure 7:
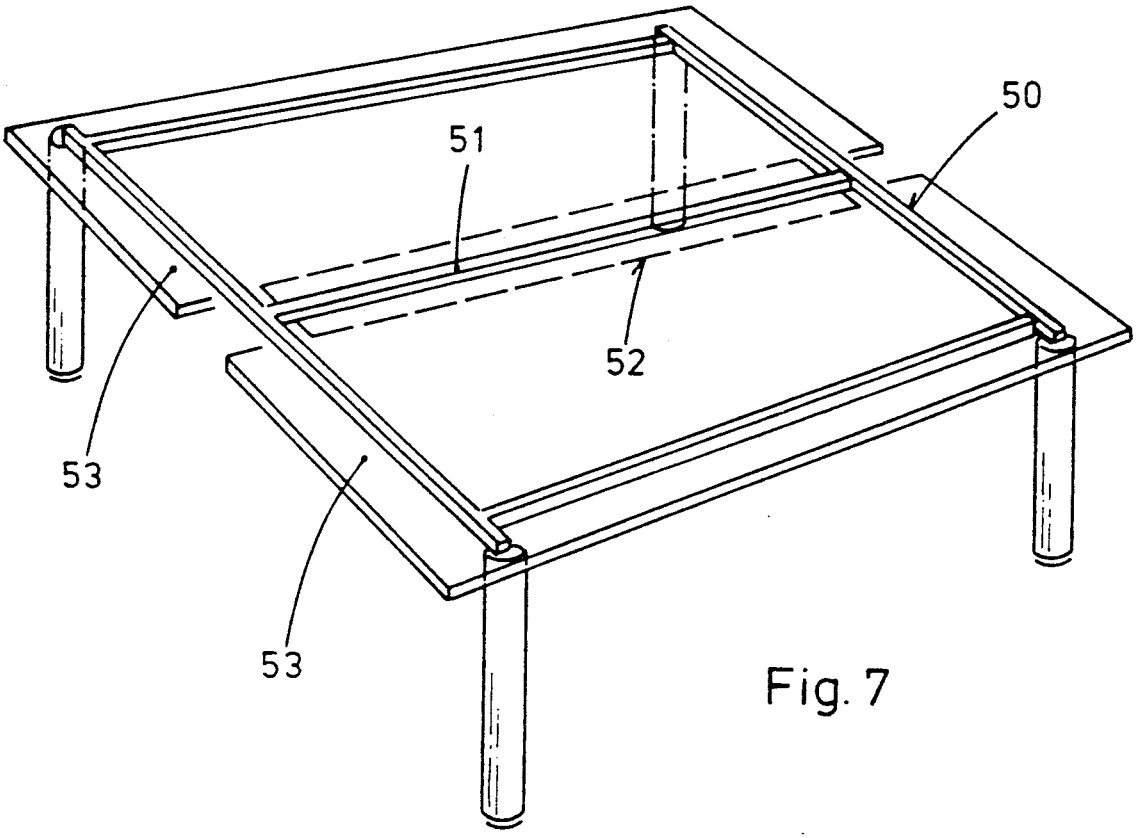
FIG. 7 shows a double base frame for receiving two table tops, with a central bearer for the support of a resting surface placed on top.

FIG. 7 shows a double base frame in a diagrammatic representation for receiving two table tops 53 on the same supporting plane. Where these two table tops abut, supported by a longitudinal bearer 51, an assembly zone 52 is indicated, in which any add-ons, for example in the manner of FIG. 8, can be arranged.

Figure 8:
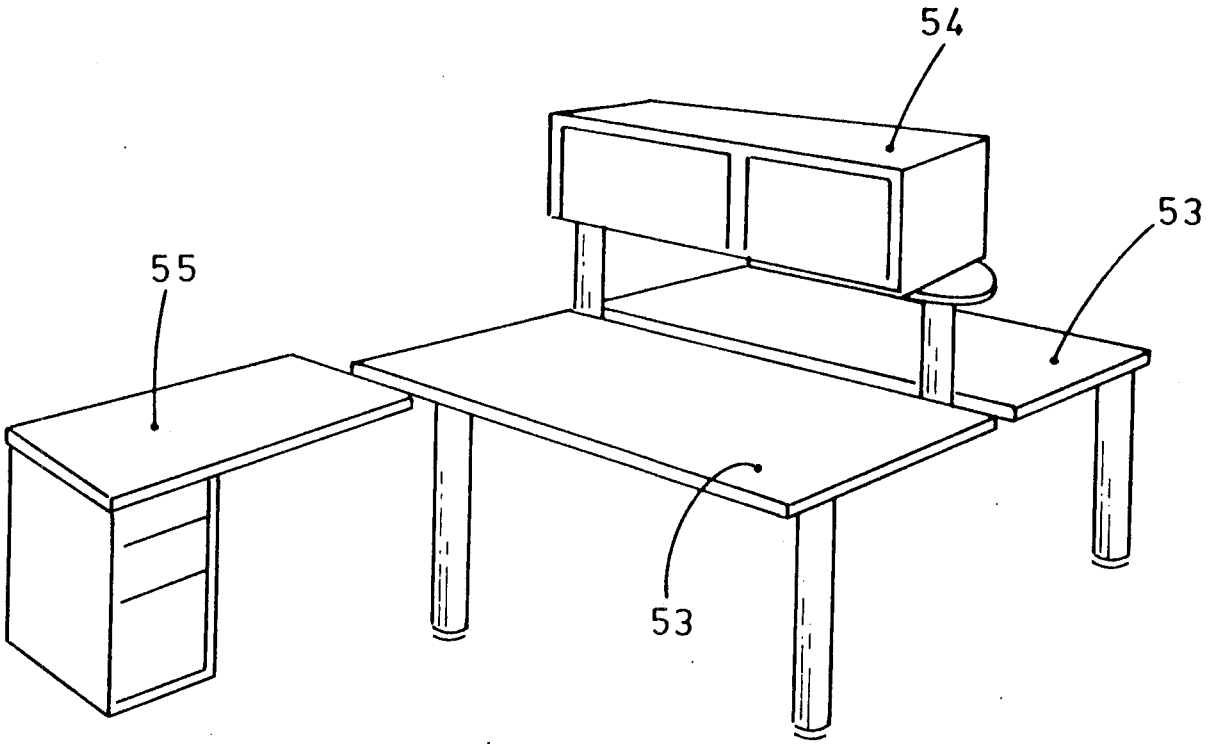
FIG. 8 shows a perspective representation of a work table with two table tops and a central resting surface placed on top.

FIG. 8 shows a work table with two table tops 53, a central add-on 54 and a carcass attachment 55, which is attached by means of a leaf frame (not shown) to the double base frame (not shown) of the work table.

It will be understood that the embodiment described herein is merely exemplary and that a person skilled in the art may make many variations and modifications without departing from the spirit and scope of the invention. All such modifications are intended to be included within the scope of the invention as defined in the appended claims.

We claim:

1. A work table, comprising:

a base frame with an upper side and an underside, said base frame including a first pair of hollow bearer members spaced apart from each other so as to form opposed sides of said base frame and a second pair of hollow bearer members spaced apart from each other so as to from opposed ends of said base frame, each bearer member of said second pair of bearer members being attached to said bearer members of said first pair of bearer members at right angles thereto, whereby said first pair of bearer members cooperate with said second pair of bearer members to form a structural unit capable of supporting a table top surface upon said upper side of said base frame, at least one of said bearer members of said base frame having an open end which is not obstructed by any of the other of said bearer members; supporting means detachably connected to said underside of said base frame for supporting said base frame above an underlying surface; a leaf frame, said leaf frame including a vertical support and a hollow horizontal bar cantilevered from said vertical support such that one end of said horizontal bar is attached to said vertical support and an opposite end of said horizontal bar extends outwardly from said vertical support and is open; and coupling means for coupling said base frame to said leaf frame, said coupling means having a first coupling element sized and shaped so as to fit within said open end of said at least one of said bearer members of said base frame and a second coupling element sized and shaped so as to fit within said opposite end of said horizontal bar of said leaf frame, wherein said coupling means couples said horizontal bar of said leaf frame to said at least one of said bearer members of said base frame such that said leaf frame can articulate relative to said base frame.

2. A work table according to claim 1, wherein said open end of said at least one of said bearer members is located in a corner region of said base frame.

3. A work table according to claim 2, wherein another of said bearer members of said base frame has an open end which is not obstructed by any of the other of said bearer members and which is sized and shaped so as to receive another coupling means for coupling an attachment to said base frame.

4. A work table according to claim 1, wherein said supporting means includes table legs.

5. A work table according to claim 1, wherein said supporting means includes drawer units.

6. A work table according to claim 1, wherein said vertical support includes table legs.

7. A work table according to claim 1, wherein said vertical support includes drawer units.

8. A work table according to claim 1, wherein said coupling means includes a hinge having a first portion disposed within said open end of said at least one of said bearer members of said base frame, a second portion disposed within said opposite end of said horizontal bar of said leaf frame, and a pin about which said first and second portions pivot.

9. A work table according to claim 1, wherein said leaf frame further includes mounting means for mounting attachments on said leaf frame.

10. A work table according to claim 1, wherein said base frame further includes mounting means for adjustably mounting a table top surface to said base frame.

11. A work table according to claim 10, wherein said mounting means includes a first pair of bearing elements spaced apart from each other and positioned such that each bearing element of said first pair of bearing elements is on a corresponding one of said opposed sides of said base frame, each bearing element of said first pair of bearing elements including a perforated strip having a plurality of holes arranged linearly along said perforated strip and perpendicularly to said base frame and a swivel lever connected between said table top surface and one of said holes in said perforated strip, whereby the inclination of said table top surface is determined by which of said holes said swivel lever is connected to, and a second pair of bearing elements spaced apart from each other and positioned such that each bearing element of said second pair of bearing elements is on a corresponding one of said opposed sides of said base frame, each bearing element of said second pair of bearing elements including a longitudinal guide slot having an upwardly extending access opening and a latching plate connected to said table top surface and having a pin slidably received in said guide slot, whereby the horizontal position of said table top surface is determined by the location of said pin relative to said guide slot.

12. A work table according to claim 1, wherein said base frame further includes another bearer member positioned between said bearer members of said first pair of bearer members and extending from one bearer member of said second pair of bearer members to the other bearer member of said second pair of bearer members.

13. A work table according to claim 1, wherein said base frame further includes a tray positioned between said first pair of bearer members and said second pair of bearer members.

14. A work table, comprising:

a base frame with an upper side and an underside, said base frame including a first pair of hollow bearer members spaced apart from each other so as to form opposed sides of said base frame and a second pair of hollow bearer members spaced apart from each other so as to form opposed ends of said base frame, each bearer member of said second pair of bearer members being attached to said bearer members of said first pair of bearer members at right angles thereto, whereby said first pair of bearer members cooperates with said second pair of bearer members to form a structural unit capable of supporting a table top surface upon said upper side of said base frame, at least one of said bearer members of said base frame having an open end which is not obstructed by any of the other of said bearer members and which is sized and shaped so as to receive coupling means for coupling an attachment to said base frame; supporting means detachably connected to said underside of said base frame for supporting said base frame above an underlying surface; and mounting means for adjustably mounting said table top surface to said base frame, said mounting means including a first pair of bearing elements spaced apart from each other and positioned such that each bearing element of said first pair of bearing elements is on a corresponding one of said opposed sides of said base frame, each bearing element of said first pair of bearing elements including a perforated strip having a plurality of holes arranged linearly along said perforated strip and perpendicularly to said base frame and a swivel lever connected between said table top surface and one of said holes in said perforated strip, whereby the inclination of said table top surface is determined by which of said holes said swivel lever is connected to, and a second pair of bearing elements spaced apart from each other and positioned such that each bearing element of said second pair of bearing elements is on a corresponding one of said opposed sides of said base frame, each bearing element of said second pair of bearing elements including a longitudinal guide slot having an upwardly extending access opening and a latching plate connected to said table top surface and having a pin slidably received in said guide slot, whereby the horizontal position of said table top surface is determined by the location of said pin relative to said guide slot.

* * * * *